United States Patent [19]

Chen et al.

[11] Patent Number: 4,992,189

[45] Date of Patent: Feb. 12, 1991

[54] LUBRICANTS AND LUBE ADDITIVES FROM HYDROXYLATION AND ESTERIFICATION OF LOWER ALKENE OLIGOMERS

[75] Inventors: Catherine S. H. Chen, Berkley Heights; Paul G. Rodewald, Rocky Hill, both of N.J.

[73] Assignee: Mobil Oil Corporation, Fairfax, Va.

[21] Appl. No.: 476,081

[22] Filed: Feb. 7, 1990

[51] Int. Cl.[5] ..... C10M 129/08; C10M 129/74

[52] U.S. Cl. ..... 252/55; 252/56 R; 252/56 S; 252/52 A

[58] Field of Search ..... 585/517, 533; 252/52 A, 252/55

[56] References Cited

U.S. PATENT DOCUMENTS

| | | | |
|---|---|---|---|
| 3,082,192 | 3/1963 | Kirshenbaum et al. | 252/55 |
| 3,388,067 | 6/1968 | Takashima et al. | 252/55 |
| 3,475,338 | 10/1969 | Carlos et al. | 252/55 |
| 4,520,221 | 5/1985 | Chen | 585/517 |
| 4,524,232 | 6/1985 | Chester et al. | 585/517 |
| 4,547,609 | 10/1985 | Dessau | 585/517 |
| 4,568,786 | 2/1986 | Chen et al. | 585/533 |
| 4,587,368 | 5/1986 | Pratt | 585/517 |
| 4,658,079 | 4/1987 | Chen | 585/533 |
| 4,743,391 | 5/1988 | Gordon et al. | 252/55 |
| 4,754,096 | 6/1988 | Chang et al. | 585/533 |

FOREIGN PATENT DOCUMENTS

| | | | |
|---|---|---|---|
| 123424 | 10/1984 | European Pat. Off. | 252/55 |

*Primary Examiner*—Olik Chaudhuri
*Assistant Examiner*—Ellen McAvoy
*Attorney, Agent, or Firm*—Alexander J. McKillop; Charles J. Speciale; Malcolm D. Keen

[57] ABSTRACT

Oligomers produced from lower olefins or alkenes by acidic zeolite catalyzed oligomerization can be converted to useful lubricant additives or lubricants by hydroxylation of olefinic bonds in the oligomers, whereby oligomers containing 1,2-glycol groups are produced. It has also been discovered that these glycols can be esterified to provide oligomers that also exhibit useful properties as lube additives or lubricants. The discovery is particularly applicable to the hydroxylation and esterification of oligomers produced from lower olefins such as propylene by oligomerization using ZSM-5 catalyst which has been surface deactivated.

12 Claims, No Drawings

LUBRICANTS AND LUBE ADDITIVES FROM HYDROXYLATION AND ESTERIFICATION OF LOWER ALKENE OLIGOMERS

This invention relates to hydroxylated and esterified oligomers of lower alkenes exhibiting lubricant properties and lubricant additive qualities. In particular, the invention relates to the hydroxylated product and process to produce novel alkene oligomers containing 1,2-glycol functionality and esters derived therefrom. The invention further relates to mixtures of these novel hydroxylated or esterified oligomers with mineral oil and synthetic lubricants systems and their utilization as additives for lubricant compositions.

BACKGROUND OF THE INVENTION

Recent work in the field of olefin upgrading has resulted in a catalytic process for converting lower olefins to heavier hydrocarbons. Heavy distillate and lubricant range hydrocarbons can be synthesized over ZSM-5 type catalysts at elevated temperature and pressure to provide a product having substantially linear molecular conformations due to the ellipsoidal shape selectivity of certain medium pore catalysts.

Conversion of olefins to gasoline and/or distillate products is disclosed in U.S. Pat. Nos. 3,960,978 and 4,021,502 (Givens, Plank and Rosinski) wherein gaseous olefins in the range of ethylene to pentene, either alone or in admixture with paraffins are converted into an olefinic gasoline blending stock by contacting the olefins with a catalyst bed made up of a ZSM-5 type zeolite. Particular interest is shown in a technique developed by Garwood, et al., as disclosed in European patent application No. 83301391.5, published Sept. 29, 1983. In U.S. Pat. Nos. 4,150,062; 4,211,640 and 4,227,992 Garwood et al disclose the operating conditions for the Mobil Olefin to Gasoline/Distillate (MOGD) process for selective conversion of $C_3+$ olefins to mainly aliphatic hydrocarbons.

In the process for catalytic conversion of olefins to heavier hydrocarbons by catalytic oligomerization using a medium pore shape selective acid crystalline zeolite, such as ZSM-5 type catalyst, process conditions can be varied to favor the formation of hydrocarbons of varying molecular weight. At moderate temperature and relatively high pressure, the conversion conditions favor $C_{10}+$ aliphatic may be converted; however, the distillate mode conditions do not convert a major fraction of ethylene. A typical reactive feedstock consists essentially of $C_3$–$C_6$ mono-olefins, with varying amounts of nonreactive paraffins and the like being acceptable components.

U.S. Pat Nos. 4,520,221, 4,568,786 and 4,658,079 to C. S. H. Chen et al., incorporated herein by reference in their entirety, disclose further advances in zeolite catalyzed olefin oligomerization. These patents disclose processes for the preparation of high viscosity index lubricant range hydrocarbons by oligomerization of light olefins using zeolite catalyst such as ZSM-5. The oligomers so produced are essentially linear in structure and contain olefin unsaturation. These unique olefinic oligomers are produced by surface deactivation of the ZSM-5 type catalyst by pretreatment with a surface-neutralizing base.

The formulation of lubricants typically includes an additive package incorporating a variety of chemicals to improve or protect lubricant properties in application specific situations, particularly internal combustion engine and machinery applications. The more commonly used additives include oxidation inhibitors, rust inhibitors, antiwear agents, pour point depressants, detergent-dispersants, viscosity index (VI) improvers, foam inhibitors and the like. This aspect of the lubricant arts is specifically described in Kirk-Othmer "Encyclopedia of Chemical Technology", 3rd edition, Vol 14, pp 477–526, incorporated herein by reference. The inclusion of additives in lubricants provides a continuing challenge to workers in the field to develop improved additives of increased compatibility with the lubricant and other additives or new additives containing a multifunctional capability that can reduce the number of additives required in the formulation.

The aforementioned olefinic character of the lower olefin oligomers produced by the ZSM-5 catalyzed processes of Chen et al. provides a reactive site to modify those unique oligomers to produce derivatives that can exhibit lube additive properties or improvements in lubricant characteristics. Olefin epoxidation is one known reaction which can be readily applied to a variety of olefinic compounds. Further, it is known that epoxides can be converted to 1,2-glycols. Such glycols can be prepared by hydrolysis of a separated epoxide or prepared directly from the olefin without prior separation of the epoxide. Conventionally, this is carried out by in situ formation of a peracid to oxidize the olefin to the epoxide followed by hydrolysis of the epoxide to the 1,2-glycol. The preparation of epoxides is described in Chapter 7 of Synthetic Organic Chemistry, R. Wagner and H. Zook, published by John Wiley & Sons, Inc. and hydrolysis of epoxides to 1,2-glycols is described in Chapter 5, page 172. Epoxidation and hydroxylation of alkenes is further described in Advance Organic Chemistry, by E. Royals, published by Prentice-Hall, pages 331–335. Both the Wagner and Zook and Royals references are incorporated herein by reference.

It is also known that 1,2-glycols, such as those formed from cleavage of epoxides, can be esterified by methods well known in the art to form a wide variety of esters.

Accordingly, is an object of the present invention to provide a process for the hydroxylation of olefins produced by zeolite catalyzed oligomerization of lower olefins.

Another object of the present invention to provide a process for the esterification of the hydroxylated olefins produced by hydroxylation of zeolite catalyzed oligomerization of lower olefins.

It is another object of the present invention to provide novel lubricant additives and lubricants by the hydroxylation and esterification of olefin oligomers produced from lower olefins by surface deactivated zeolite catalysts.

Yet another object of the instant invention is to provide novel lubricant mixtures from mineral oil and synthetic lubricants derived from polyalphaolefins (PAO) and containing hydroxylated and/or esterified olefin oligomers.

SUMMARY OF THE INVENTION

It has been discovered that the oligomers produced from lower olefins or alkenes by acidic zeolite catalyzed oligomerization can be converted to useful lubricant additives or lubricants by hydroxylation of olefinic bonds in the oligomers, whereby oligomers containing 1,2-glycol groups are produced It has also been discovered that these glycols can be esterified to provide oligomers that also exhibit useful properties as lube additives or lubricants with higher solubility of additives and lower volatility. The discovery is particularly applicable to the hydroxylation and esterification of oligomers produced from lower olefins such as propylene by oligomerization using ZSM-5 catalyst which has been surface deactivated.

More particularly, a reaction product has been discovered comprising aliphatic 1,2-glycol made by hydroxylation of an oligomeric alkene. The alkene comprises the oligomerization product of lower alkene oligomerized in contact with medium pore, shape selective metallosilicate catalyst under oligomerization conditions. The hydroxylation is carried out with an alkene oxidizing agent, including alkyl or aryl percarboxylic acid, hydrogen peroxide, or mixtures thereof A preferred hydroxylation agent is a mixture of hydrogen peroxide and formic acid. The products comprise a liquid lubricant containing $C_{20}+$ carbon atoms and having a viscosity at 100° C. greater than 2 cS and viscosity index measured at 100° C. greater than 50.

The present invention also includes a process for the production of liquid lubricant or lubricant additive comprising contacting an oligomeric alkene and an alkene oxidizing agent under hydroxylating conditions where the oligomeric alkene comprises the oligomerization product of lower alkene oligomerized in contact with medium pore, shape selective metallosilicate catalyst under oligomerization conditions. A hydroxylation reaction product is separated and recovered containing 1,2-glycol groups. The reaction product containing 1,2-glycol groups can be contacted with carboxylic acid, or derivative thereof, and esterification catalyst under esterification conditions; and a product separated and recovered comprising carboxylic acid ester of said 1,2-gylcol.

Novel liquid lubricant compositions have also been discovered comprising a mixture of a liquid hydrocarbon lubricant, such as mineral oil and polyalphaolefin lubricants, and the hydroxylated and/or esterified lubricant additive products of the invention. These mixtures can further include lubricant additives taken from the group consisting of dispersants, detergents, viscosity index improvers, extreme pressure/antiwear additives, antioxidants, pour depressants, emulsifiers, demulsifiers, corrosion inhibitors, antirust inhibitors, antistaining additives, friction modifiers, and the like.

DETAIL DESCRIPTION OF THE INVENTION

The olefin oligomers used as starting material in the present invention are prepared from $C_2$–$C_{10}$ olefins according to the methods presented by Chen et al. in the aforementioned patents cited and incorporated as references. Shape-selective oligomerization, as it applies to conversion of $C_2$–$C_{10}$ olefins over ZSM-5, is known to produce higher olefins up to $C_{30}$ and higher. Reaction conditions favoring higher molecular weight products are low temperature (200°–260° C.), elevated pressure (about 2000 kPa or greater) and long contact times (less than 1 WHSV). The reaction under these conditions proceeds through the acid catalyzed steps of oligomerization, isomerization-cracking to a mixture of intermediate carbon number olefins, and interpolymerization to give a continuous boiling product containing all carbon numbers. The channel system of ZSM-5 type catalysts impose shape selective constraints on the configuration of large molecules, accounting for the differences with other catalysts.

The shape-selective oligomerization/polymerization catalysts preferred for use herein to prepare the olefin oligomers used as starting material in the invention include the crystalline aluminosilicate zeolites having a silica to alumina molar ratio of at least 12, a constraint index of about 1 to 12 and acid cracking activity of about 50–300. Representative of the ZSM-5 type zeolites are ZSM-5, ZSM-11, ZSM-12, ZSM-23, ZSM-35 and ZSM-38. ZSM-5 is disclosed and claimed in U.S. Pat No. 3,702,886 and U.S. Pat. No. Re. 29,948; ZSM-11 is disclosed and claimed in U.S. Pat. No. 3,709,979. Also, see U.S. Pat. No. 3,832,449 for ZSM-12; U.S. Pat. No. 4,076,842 for ZSM-23; U.S. Pat. No. 4,016,245 for ZSM-35 and U.S. Pat. No. 4,046,839 for ZSM-38. The disclosures of these patents are incorporated herein by reference. A suitable shape selective medium pore catalyst for fixed bed is a small crystal H-ZSM-5 zeolite (silica:alumina ratio =70:1) with alumina binder in the form of cylindrical extrudates of about 1–5 mm. Unless otherwise stated in this description, the catalyst shall consist essentially of ZSM-5, which has a crystallite size of about 0.02 to 0.05 micron Other pentasil catalysts which may be used in one or more reactor stages include a variety of medium pore siliceous material disclosed in U.S. Pat. Nos. 4,414,423 and 4,417,088, incorporated herein by reference.

The acid catalysts are deactivated by pretreatment with a surface-neutralizing base, as disclosed by Chen in the patents incorporated by reference.

Considering propylene oligomerization for purposes of illustration, the olefinic oligomerization-polymerization products include $C_{10}+$ substantially linear aliphatic hydrocarbons. The ZSM-5 catalytic path for propylene feed provides a long chain with approximately one lower alkyl (e.g., methyl) substituent per 8 or more carbon atoms in the straight chain. The lubricant range product can be depicted as a typical linear molecule having a sparingly-substituted long carbon chain with some olefinic unsaturation.

Olefinic oligomer lube range materials can be obtained in a two-stage process or a single stage process. Generally, in the two stage process the first stage involves oligomerization of an inexpensive lower olefin of, e.g., propylene at about 200° C. over a surface poisoned HZSM-5. The second stage involves further oligomerization/interpolymerization of the product (or a fraction of the product) from the first stage over a second and/or different acid catalyst, which may be modified or unmodified as disclosed herein, at about 100°–260° C. The temperature of the second state, i.e., about 25°–75° C. lower and preferably the catalyst is an unmodified ZSM-5 type catalyst. Both high yields and high VI are achieved by this two-stage process. In a single stage process only the first stage of the two stage process is employed. Lubes of extremely high viscosity index are achieved but at a lower yields than the two stage process.

Conventional temperatures, pressures and equipment may be used in the oligomerization process. Preferred temperatures may vary from about 100° C. to about 350° C., preferably 150° C. to 250° C. pressures from about atmospheric to 20,000 kPa (3000 psi) and WHSV from about 0.01 to about 2.0, preferably 0.2 to 1.0 are employed.

EXAMPLE 1

Hydroxylation of olefins having the average composition $C_{254}H_{50}$ is carried out using performic acid at 43°

C. To a rapidly stirred solution of 30% hydrogen peroxide (7.94 g, 0.0700 mole) in 89% formic acid (35.42 g, 0.685 mole) is added dropwise 17.53 g (0.0500 mole) olefins. The glycol product weighs 17.86 g and shows a broad hydroxyl absorption centered at 3478 $cm^{-1}$ in its infrared spectrum as well as 2.81% oxygen by elemental analysis The following table compares the viscometric properties of the starting olefin with those of the hydroxylated product.

| | Fresh | Hydroxylated |
|---|---|---|
| Viscosity at 100° C. | 2.8 | 3.2 |
| Viscosity Index (100° C.) | 93 | 58 |

EXAMPLE 2

Esterification of the glycols of Example 1 is carried out as follows a solution of lube glycols (3.85 g, 0.0100 mole), acetic anhydride (4.08 g, 0.0500 mole), and 10 g pyridine is stirred at 75° C. overnight. The ester product weighs 3.88 g and shows an ester carbonyl absorption at 1738 $cm^{-1}$ as well as 3.59% oxygen by elemental analysis. The following table compares the viscometric properties of the starting olefin, the glycol, and the ester products.

| | Fresh | Hydroxylated | Esterified |
|---|---|---|---|
| Viscosity at 100° C. | 2.8 | 3.2 | 3.2 |
| Viscosity Index (100° C.) | 93 | 58 | 78 |

The preferred process of the present invention involves reaction of oligomeric olefins with performic acid prepared in situ from formic acid and hydrogen peroxide under conditions sufficient to produce 1,2-glycols. It is known that epoxides are formed as intermediate products which at conditions of elevated reaction temperature cleave to form the corresponding 1,2-glycol as indicated in Example 1. Lube range olefins may be utilized as starting material or olefins with molecular weights below lube range can be converted into lube range material by hydroxylation followed by esterification. These materials show increased viscosity and somewhat reduced viscosity index and a higher boiling range or lower volatility. They show utility directly as additives to lubricating oils to improve solubility of other additives or indirectly as reactive intermediates for the production of further additives.

The hydroxylation reaction can be carried out at temperatures from −20° C. to 250° C. and at subatmospheric, atmospheric or supra-atmospheric pressures. Preferably, the reaction is carried out batchwise by the addition of the olefin to a solution of the epoxidizing-/hydroxylating agent. The product is isolated by conventional means to provide the 1,2-glycol oligomer in high yield.

The 1,2-glycols produced from the process illustrated in Example 1 can be esterified by known means using aliphatic or aromatic mono or dicarboxylic acids or derivatives thereof, such as anhydrides or acyl halides. Useful carboxylic acids, anhydrides or acyl halides in the present invention include those containing four to twenty carbon atoms. Particularly useful acid or anhydrides include acetic, propionic, butyric, valeric, hexanoic, heptanoic, octanoic, benzoic, phenylacetic, naphthoic, phthalic, malonic, maleic, glutaric, and the like.

It has been determined that the products of the instant invention produce novel lubricant mixtures when mixed with the hydrocarbon lubricants known in the art, including mineral oil and synthetic lubricants such as those derived from the oligomerization of alphaolefins in contact with cationic and Ziegler catalyst. The hydroxylated and/or esterified oligomers can be added to the lubricants in amounts ranging from 0 1% to 99% by mixing. The mixtures may further contain lubricant additives taken from the group consisting of dispersants, detergents, viscosity index improvers, extreme pressure/antiwear additives, antioxidants, pour point depressants, emulsifiers, demulsifiers, corrosion inhibitors, antirust inhibitors, antistaining additives, friction modifiers, and the like.

While the instant invention has been described by specific examples and embodiments, there is no intent to limit the inventive concept except as set forth in the following claims.

What is claimed is:

1. A process for the production of liquid lubricant or lubricant additive comprising;

contacting an oligomeric alkene and an alkene oxidizing agent under hydroxylating conditions, said alkene comprising the oligomerization product of lower alkene oligomerized in contact with medium pore, shape selective metallosilicate catalyst under oligomerization conditions;

separating the hydroxylation reaction product and recovering said liquid lubricant or additive containing 1,2-glycol groups.

2. The process of claim 1 wherein said oxidizing agent includes alkyl or aryl percarboxylic acid, hydrogen peroxide, or mixtures thereof.

3. The process according to claim 1 wherein said liquid lubricant contains $C_{20}+$ carbon atoms having a viscosity at 100° C. greater than 2 cS and viscosity index greater than 50.

4. The process according to claim 1 wherein said metallosilicate catalyst comprises ZSM-5 catalyst.

5. The process according to claim 4 wherein the surface of said catalyst is rendered substantially inactive for acid reactions by treatment with a surface deactivating agent.

6. The process according to claim 1 further comprising contacting said liquid lubricant or additive containing 1,2-glycol groups with carboxylic acid, or derivative thereof, and esterification catalyst under esterification conditions;

separating and recovering a product comprising carboxylic acid ester of said 1,2-gylcol.

7. The process of claim 6 wherein said carboxylic acid includes aliphatic and aromatic mono and dicarboxylic acids containing two to twenty carbon atoms and said derivatives include carboxylic acid anhydrides and halides.

8. The process of claim 6 wherein said carboxylic acid comprises acetic anhydride and said esterification catalyst comprises tertiary amine, whereby the acetate ester of said 1,2-glycol is produced.

9. A liquid lubricant or lubricant additive composition comprising the reaction prepared according to the process of claim 6.

10. A liquid lubricant composition comprising a mixture of a liquid hydrocarbon lubricant and the lubricant additive made according to the process of claim 1 or 6.

11. The composition of claim 10 wherein said liquid hydrocarbon lubricant includes mineral oil and polyalphaolefin lubricants.

12. The mixture of claim 10 further comprising lubricant additives taken from the group consisting of dispersants, detergents, viscosity index improvers, extreme pressure/antiwear additives, antioxidants, pour depressants, emulsifiers, demulsifiers, corrosion inhibitors, antirust inhibitors, antistaining additives, friction modifiers, and the like.

* * * * *